US008573458B1

(12) United States Patent
Hamilton

(10) Patent No.: US 8,573,458 B1
(45) Date of Patent: Nov. 5, 2013

(54) ATTACHABLE CARRIER FOR PORTABLE ARTICLES

(71) Applicant: SIMPLE.BE LLC, Lake Oswego, OR (US)

(72) Inventor: Brett Hamilton, Tualatin, OR (US)

(73) Assignee: Simple.be LLC, Lake Oswego, OR (US)

( * ) Notice: Subject to any disclaimer, the term of this patent is extended or adjusted under 35 U.S.C. 154(b) by 0 days.

(21) Appl. No.: 13/803,532

(22) Filed: Mar. 14, 2013

(51) Int. Cl.
*A45F 3/14* (2006.01)

(52) U.S. Cl.
USPC ..... 224/674; 224/250

(58) Field of Classification Search
USPC ..... 224/250, 246, 901, 901.2, 674, 671, 224/672, 675, 148.6; 294/150; 248/693; D3/229
See application file for complete search history.

(56) References Cited

U.S. PATENT DOCUMENTS

| | | | | | |
|---|---|---|---|---|---|
| 551,359 | A | | 12/1885 | Braillard | |
| 1,816,284 | A | | 7/1931 | Hughes | |
| 3,127,076 | A | | 3/1964 | Tebbs | |
| 3,813,017 | A | | 5/1974 | Pimsleur | |
| 4,057,757 | A | * | 11/1977 | Darden, Jr. | 455/90.3 |
| 4,399,934 | A | | 8/1983 | Dupont | |
| 4,420,104 | A | | 12/1983 | Dilenno | |
| D275,815 | S | * | 10/1984 | Dilenno | D3/226 |
| D281,830 | S | | 12/1985 | Henesbach | |
| 4,982,885 | A | | 1/1991 | Severson et al. | |
| 5,104,076 | A | * | 4/1992 | Goodall, Jr. | 248/205.2 |
| 5,147,079 | A | * | 9/1992 | Heather | 224/148.6 |
| 5,184,762 | A | * | 2/1993 | Nevitt | 224/148.6 |
| D347,522 | S | * | 6/1994 | Beltran | D3/229 |
| 5,535,928 | A | | 7/1996 | Herring | |
| 5,622,346 | A | * | 4/1997 | Story, Jr. | 248/311.2 |
| 5,806,730 | A | | 9/1998 | Deno | |
| D419,392 | S | | 1/2000 | Schlebusch | |
| 6,056,174 | A | | 5/2000 | Minckler | |
| 6,076,789 | A | | 6/2000 | Jackson | |
| 6,081,695 | A | | 6/2000 | Wallace et al. | |
| 6,321,958 | B1 | | 11/2001 | Erdmann | |
| 6,412,674 | B1 | | 7/2002 | Lipke | |
| D467,069 | S | | 12/2002 | TenHoeve | |
| 6,533,150 | B1 | | 3/2003 | Margo et al. | |
| D490,237 | S | | 5/2004 | Hardge | |
| D517,314 | S | * | 3/2006 | Moyer | D3/229 |

(Continued)

FOREIGN PATENT DOCUMENTS

CA 2395918 A1 1/2004

OTHER PUBLICATIONS

Brett Hamilton, Smart Phone Holster, Sep. 2008 (Public Disclosure), Simple.be LLC, West Linn, OR.

(Continued)

*Primary Examiner* — Nathan J Newhouse
*Assistant Examiner* — Todd Anderson
(74) *Attorney, Agent, or Firm* — Stone Creek Services LLC; Alan M Flum

(57) ABSTRACT

Disclosed is a portable article carrier for carrying and securing portable articles such as mobile phones, cameras, radios, tools, and water bottles; where the device can be secured to a belt, strap, or harness that is optionally worn by a wearer. The portable article carrier can be assembled from a folded flexible strap member and a loop member. The loop member can be flexible, non-flexible, or elastic. The portable article carrier can be configured to present a seamless surface to the portable article in order to minimize surface damage or wear to the portable article.

5 Claims, 26 Drawing Sheets

(56) References Cited

U.S. PATENT DOCUMENTS

| | | | | |
|---|---|---|---|---|
| D540,031 | S | 4/2007 | Bouchard | |
| D547,618 | S | 7/2007 | Exler | |
| 7,640,632 | B2 * | 1/2010 | Lazarus | 24/17 B |
| D654,265 | S | 2/2012 | Roy | |
| 8,162,285 | B2 | 4/2012 | Rooker | |
| 2007/0205244 | A1 | 9/2007 | Hewes, Jr. | |
| 2008/0121673 | A1 | 5/2008 | Timm et al. | |
| 2009/0127304 | A1 | 5/2009 | Uygur | |
| 2013/0119098 | A1 * | 5/2013 | Stiefel | 224/183 |

OTHER PUBLICATIONS

Maxepedition CPM, accessed on the Internet at: http://www.maxpedition.com/store/pc/CP-M-8p2.htm on Jan. 2, 2013.

Maxpedition #0109, accessed on the Internet at: http://www.maxpedition.com/store/pc/4-5-CLIP-ON-PHONE-HOLSTER-p441.htm on Jan. 2, 2013.

Maxpedition 3.5" Clip-on Phone Holster, accessed on the Internet at: http://www.maxpedition.com/store/pc/3-5-CLIP-ON-PHONE-HOLSTER-p413.htm on Jan. 2, 2013.

SumoStrap Assembly Instructions, pp. 1-2, Estimated Date of Publication: as early as Jan. 1, 2004, Fastcap Inc., Bellingham, WA.

Innovation, Fastcap 2004 Catalog, p. 14, Jan. 1, 2004, Fastcap Inc., Bellingham, WA.

Heavy-Duty Phone Holder by Dewalt, accessed on the Internet at: http://www.constructiongear.com/dewalt-heavy-duty-cell-phone-holder-5126.html on Jan. 4, 2013.

Belt Cell Phone/Camera Holder, accessed on the Internet at: http://www.reliableracing.com/detail.cfm?edp=10927572 on Jan. 5, 2013.

SwimAndTri: Fuel Belt Cell phone holder,accessed on the Internet at: http://www.swimandtri.com/Scripts/Fuel_Belt_Cell_phone_holder_Product341.aspx on Jan. 5, 2013.

McGuire-Nicholas Cell Rider Cell Phone Holder at The Home Depot, accessed on the Internet at: http://www.homedepot.com/buy/mcguire-nicholas-cellrider-cell-phone-holder-31509.html#.UOj0AYmEEoY on Jan. 5, 2013.

Holster Pouch, accessed on the Internet at: www.boxwave.com/holsters/holster-pouch/bwpds/pw/ on Mar. 1, 2013.

Heavy Guard PDA Pouch with Belt Clip, accessed on the Internet at: http://www.militaryuniformsupply.com/pda-pouch-with-belt-clip with-belt-clip on Jan. 2, 2013.

Seidio Horizontal Leather Case, accessed on the Internet at: www.seidioonline.com/blackberry-pearl-8100-horizontal-leather-case-p/d-csl3bb8100-hc.htm on Mar. 1, 2013.

Clearing Clutter in Cars, Jan. 22, 2004, The Early Show, CBSNews.com, accessed on the Internet at: web.archive.org/web/20040810150547/http://www.cbsnews.com/stories/2004/06/21/earlyshow/living/main625174.shtml on Mar. 4, 2013.

Galls: Phone Holders, accessed on the Internet at: www.galls.com/CGBCSRCH?PMWTNO=000000000001577 on Mar. 1, 2013.

* cited by examiner

ATTACHABLE CARRIER FOR PORTABLE ARTICLES

BACKGROUND

The present disclosure relates to a device for carrying portable articles, for example, cell phones, smart phones, tablet computers, portable media players, tools, beverage containers, and water bottles; where the device can be secured to a belt, strap, or harness that is optionally worn by a wearer.

Portable articles, such as smart phones or mobile media devices, are often small enough to fit into a garment worn by a wearer, for example, pants, vest, or jacket pockets. While it can be convenient for the wearer to store the portable article in their garment, there may be one or more disadvantages for doing so. For example, the portable article may be difficult to access when the wearer is sitting; or the article may not be securely retained and can slip out of the garment when the wearer moves or changes positions.

Alternatively, a wearer can carry the portable article in a body-worn portable article carrier, for example, a belt-worn holster secured to the wearer's belt by a spring-loaded clip. Many of the presently available body-worn article carriers suffer from one or more deficiencies. For example, the spring-loaded clip of some belt-worn holsters can become loose, or fatigue and break through the stress of daily use. In addition, the spring-clip can be rigid and bulky; this can make the holster uncomfortable to wear. Even belt-worn article carriers that do not utilize spring-loaded clips can also potentially be uncomfortable due to the bulk, thickness, and rigidity of their design.

SUMMARY

This Summary introduces a selection of concepts in simplified form that are described in the Description. The Summary is not intended to identify essential features or limit the scope of the claimed subject matter.

The present disclosure describes a portable article carrier that overcomes one or more of the challenges, described in the Background section of this disclosure, in the design of portable article carriers. The presently disclosed portable article carrier includes a flexible strap member that is folded, forming a fold that defines a first strap portion and a second strap portion. The portable article carrier also includes a loop member. The loop member includes two opposing side portions, a loop side portion and an opposing loop side portion. The loop member can be either a continuous loop or can be a flat length of material with its ends brought in proximity to form a loop. The loop can be made of a flexible material, an elastic material, or a rigid material, depending on the nature of the portable article to be held within the portable article carrier. The loop side portion is positioned between, and permanently secured to, the first strap portion and the second strap portion near the fold. The opposing loop side portion is positioned between, and permanently secured to, the first strap portion and the second strap portion.

The first strap portion includes a first strap portion distal end. The first strap portion distal end includes an end portion, region, or section of the first strap portion that is distal to the fold, and ends at the terminus of the first strap portion. The second strap portion includes a second strap portion distal end. The second strap portion distal end includes an end portion, region, or section of the second strap portion that is distal to the fold, and ends at the terminus of the second strap portion. In one aspect, the first strap portion distal end can be used as a closure flap. In another aspect, the second strap portion distal end is securable to the second strap portion. If the second strap portion distal end is secured to the back portion of the portable article carrier, it can become a support loop portion and may be used to secure the portable article carrier to an external support strap, for example, a waist belt. The second strap portion distal end can be permanently secured, for example, by sewing, adhesive-bonding, or heat-bonding. Alternatively the second strap portion distal end can be removably secured by a complementary closure, for example, a button, a snap fastener, a magnetic closure, or a hook-and-loop fastener.

DRAWINGS

FIG. 1 shows the portable article carrier worn on the belt of a wearer.

FIGS. 2A-2B each show a member of the portable article carrier of FIG. 1.

DESCRIPTION

Certain relative terms are used to aid in understanding the figures. Referring to an element as "first" or "second" is meant to distinguish elements of similar function or structure. It is not meant to limit the meaning or the scope of the claims.

Figure 1:
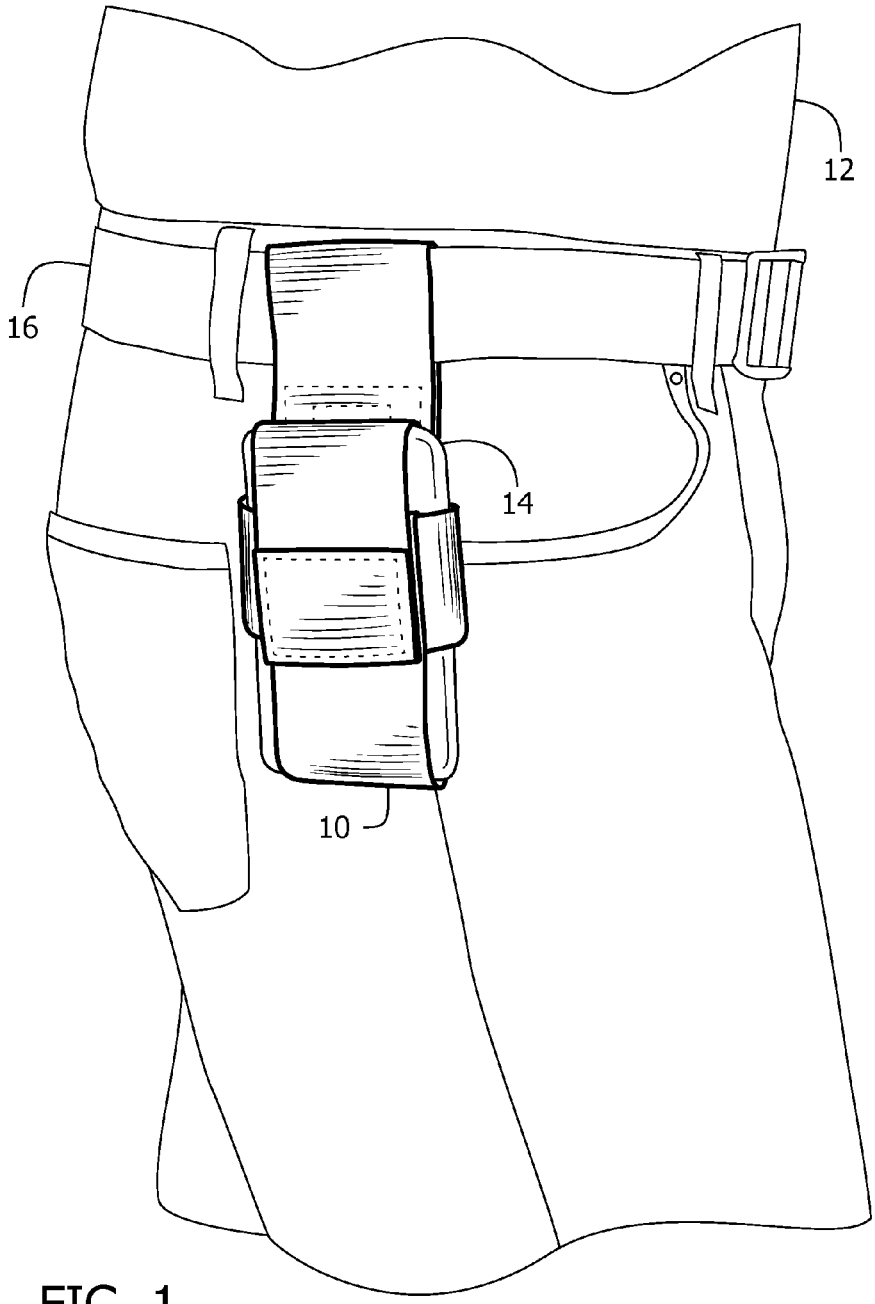

The following description is made with reference to figures, where like numerals refer to like elements throughout the several views. FIG. 1 shows a portable article carrier 10 worn by a wearer 12. The portable article carrier 10 is shown securing and holding a portable article 14. The portable article carrier 10 is secured to a waist belt 16 of the wearer 12.

Figure 2A:
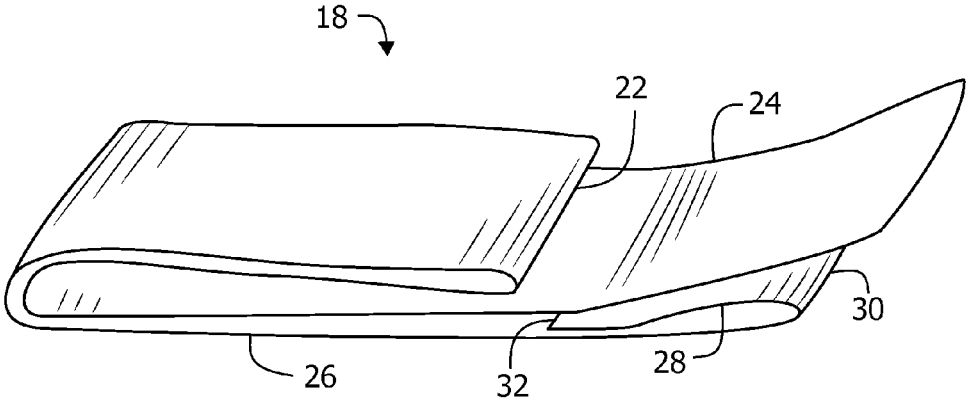
Figure 2B:
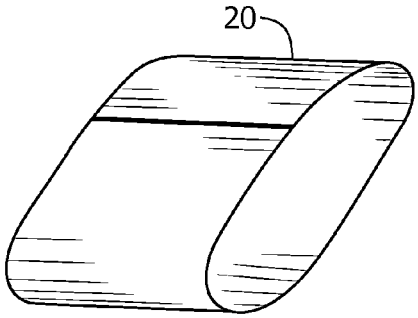

The portable article carrier 10 includes a strap member 18 shown in FIG. 2A, and a loop member 20, shown in FIG. 2B. Referring to FIG. 2A, the strap member 18 includes a first fold 22, one side of the fold defining a first strap portion 24 and the other side of the fold defining a second strap portion 26. The strap member 18 can further include a support loop portion 28 formed by a second fold 30 located proximate to the second strap portion distal end 32. As defined in this disclosure, the second strap portion distal end 32 refers to an end portion, section, or region of the second strap portion 26 distal from the first fold 22 ending at the terminus of the second strap portion 26.

In FIG. 2A, the strap member 18 can be formed from flexible material suitable for constructing support straps, for example, nylon, polyester, polypropylene, cotton, hemp, or leather. The strap member 18 can also be made out of flexible webbing material. These examples are not meant to limit the claimed invention, but are provided as examples of suitable materials. Those skilled in the art will readily recognize other equivalent materials or combination of materials of suitable strength, shape, and flexibility. In FIG. 2B, the loop member 20 can be either a continuous loop or can be a flat length of material with its ends brought in proximity to form a loop. The loop member 20 may be made from a flexible material; for example, woven nylon, polyester, polypropylene, cotton, hemp, or leather. The loop member 20 can be made out of an elastic material of suitable strength for carrying and holding the portable article 14 of FIG. 1; for example, polyester elastic fabric, or ranger band material. In FIG. 2B, the loop member 20 can also be made of a rigid material, for example, a molded plastic such as acrylonitrile butadiene styrene (ABS), non-woven nylon, or polypropylene. The loop member 20 can be separate from the strap member 18 of FIG. 2A, in that it starts out as an independent element. This allows the loop member 20 to be made of either the same material or a different material than the strap member 18 of FIG. 2A.

Figure 3:
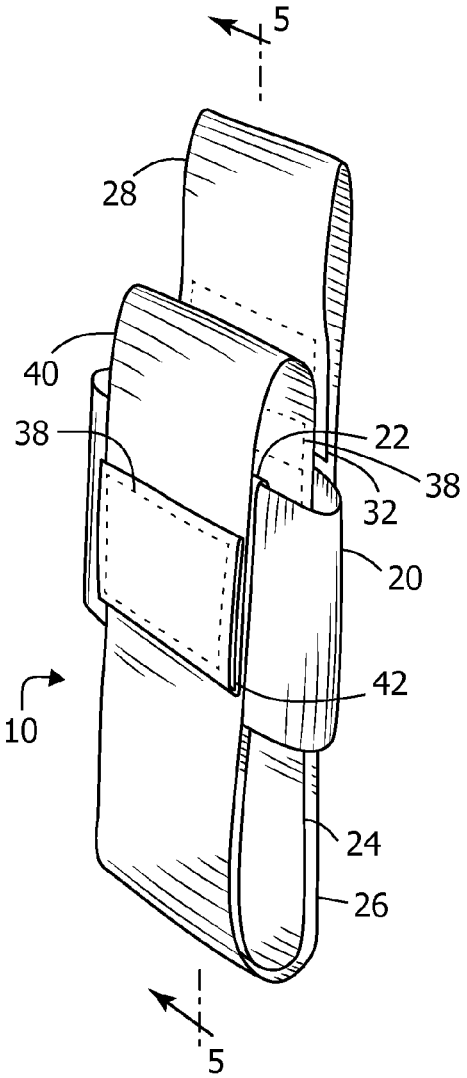
FIG. 3 shows the portable article carrier of FIG. 1 in a front perspective view.
Figure 4:
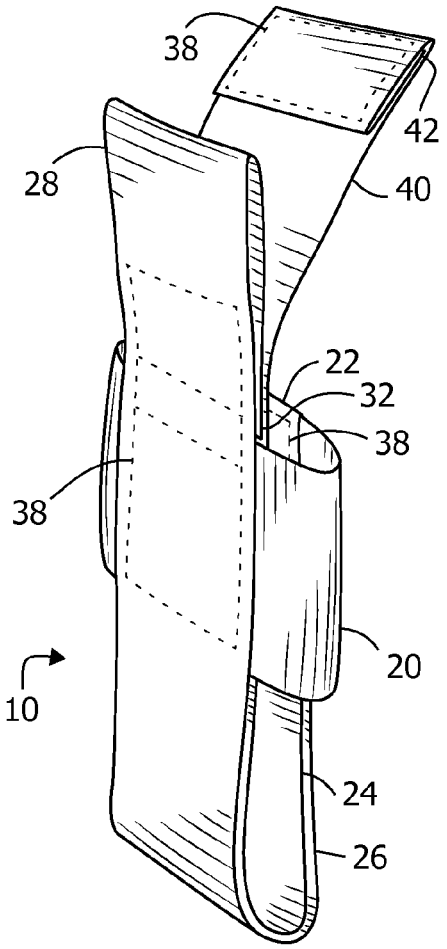
FIG. 4 shows the portable article carrier of FIG. 1 in a rear perspective view with the closure flap open.
Figure 5:
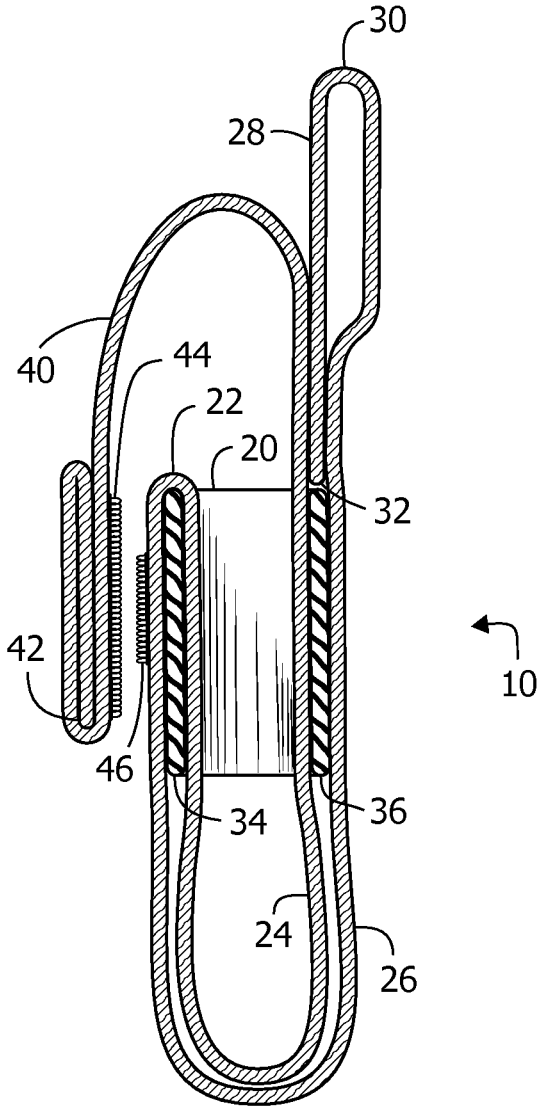
FIG. 5 shows a sectional view of the portable article carrier of FIG. 3.

FIG. 3 shows the portable article carrier 10 in a front perspective view. FIG. 4 shows the portable article carrier 10 in a rear perspective view. FIG. 5 shows a sectional view of FIG. 3. Referring to FIGS. 3-5, the first strap portion 24 and the second strap portion 26 extend downward from the first fold 22 and are looped back upward, forming the front and back of the portable article carrier 10. The first strap portion 24 forms the inside body of the portable article carrier 10. Opposing side portions of the loop member 20 are permanently secured between the first strap portion 24 and the second strap portion 26.

FIG. 5 shows a loop side portion 34 of the loop member 20 permanently secured between the first strap portion 24 and the second strap portion 26 proximate to the first fold 22. An opposing loop side portion 36 of the loop member 20 is permanently secured between the first strap portion 24 and the second strap portion 26 on the back of the portable article carrier 10. The loop side portion 34 and the opposing loop side portion 36 can be permanently secured at their respective positions between the first strap portion 24 and the second strap portion 26 by sewing, adhesives, or heat bonding. In FIGS. 3-4, sewing is indicated by stitching lines 38. The stitching lines 38 are for the purpose of illustration and should not be interpreted as favoring a particular stitching pattern; those skilled in the art will readily recognize appropriate stitching patterns.

Referring again to FIGS. 3-5, a first strap portion distal end 42 can be configured as a closure flap 40. As defined in this disclosure, the first strap portion distal end 42 refers to an end portion, section, or region of the first strap portion 24 distal from the first fold 22 ending at the terminus of the first strap portion 24.

The first strap portion distal end 42 can include outward finishing folds as illustrated, can include one or more inward finishing folds, or can be finished without folding. The closure flap 40 can be finished, for example, by sewing, adhesives, or heat-bonding. Those skilled in the art will readily recognize other methods of end finishing appropriate to the closure flap 40. In FIGS. 3-4, the finishing folds of the closure flap 40 are secured by sewing and this is represented by stitching lines 38. The stitching lines 38 are for the purpose of illustration, as previously discussed, and should not be interpreted as favoring a particular stitching pattern.

The closure flap 40 can be secured to the second strap portion 26 by a complementary closure, complementary apparel fastener, or textile closure, for example, a hook-and-loop fastener (often sold under the brand name Velcro), a magnetic closure, a snap fastener, a buckle, or a slot and latch closure. Referring to FIG. 5, the closure flap 40 is secured by a hook-and-loop fastening system. The loop component 44 of the hook-and-loop fastening system is permanently secured to the inward-facing surface of the closure flap 40. The hook component 46 of the hook-and-loop fastening system is permanently secured to the outward-facing surface of the second strap portion 26. The arrangement of the hook-and-loop fastening components can be reversed.

Referring to FIG. 5, the support loop portion 28 is shown permanently secured between the first strap portion 24 and the second strap portion 26 with the end of the support loop portion 28, which is the second strap portion distal end 32, positioned proximate to the top of the loop member 20. The support loop portion 28 can be permanently secured between the first strap portion 24 and the second strap portion 26, for example, by sewing, adhesives, or heat bonding. In FIGS. 3-4, the support loop portion 28 is shown permanently secured between the first strap portion 24 and the second strap portion 26 by sewing, indicated by stitching lines 38. The stitching lines 38 are for the purpose of illustration and should not be interpreted as favoring particular stitching lines or patterns; those skilled in the art will readily recognize any number of suitable stitching patterns. Referring again to FIG. 5, the front portion of the portable article carrier 10 is defined by a first region of the second strap portion 26 that is proximal to the first fold 22. The back portion of the portable article carrier 10 is defined by a second region of the second strap portion 26 that is proximal to the opposing loop side portion 36. In the arrangement described, the first strap portion 24 creates a continuous seamless interior contour from the front portion of the portable article carrier 10 to the back portion of the portable article carrier 10. This continuous interior contour can prevent the portable article 14 of FIG. 1 from being scratched or damaged.

Figure 6:
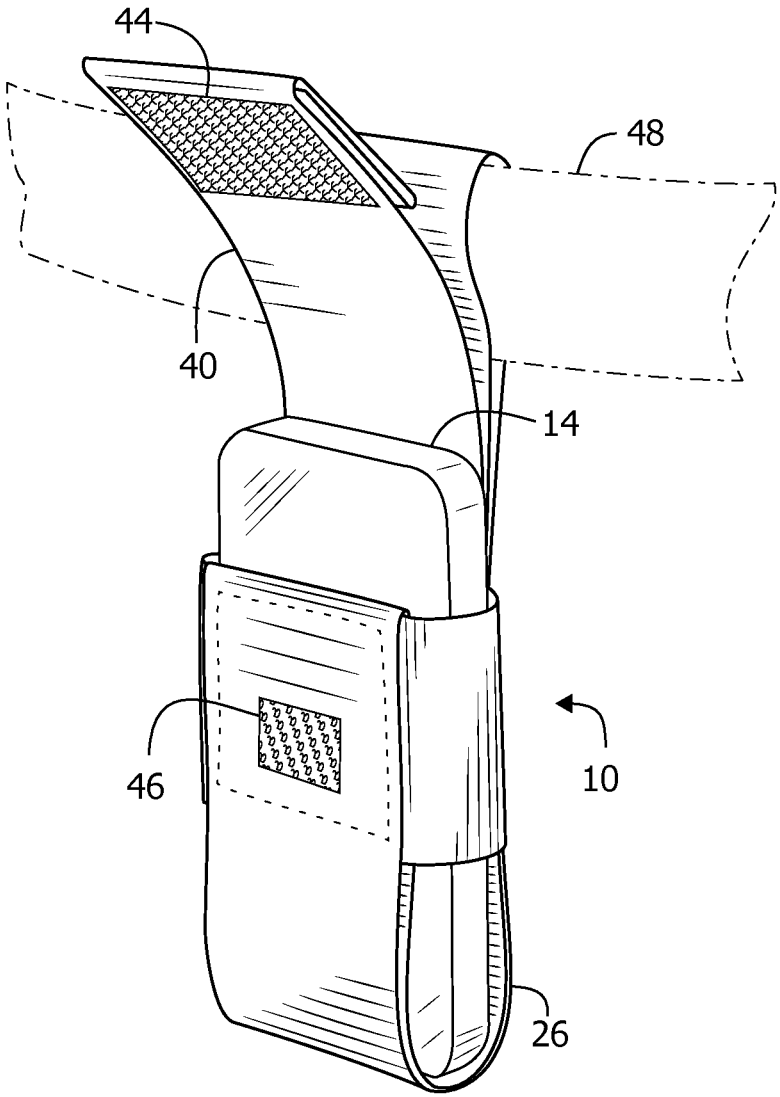
FIG. 6 shows the portable article carrier of FIG. 1 in a front perspective view with the closure flap open.

FIG. 6 shows the portable article carrier 10 in a front perspective view with the closure flap 40 open. The portable article 14 is shown resting within the portable article carrier 10. The portable article carrier 10 is shown supported by an external support strap 48; for example, the waist belt 16 of FIG. 1. The loop component 44 of the hook-and-loop fastening system is shown secured to the inward-facing surface of the closure flap 40. The hook component 46 of the hook-and-loop fastening system is shown secured to the outward-facing surface of the second strap portion 26.

Figure 7:
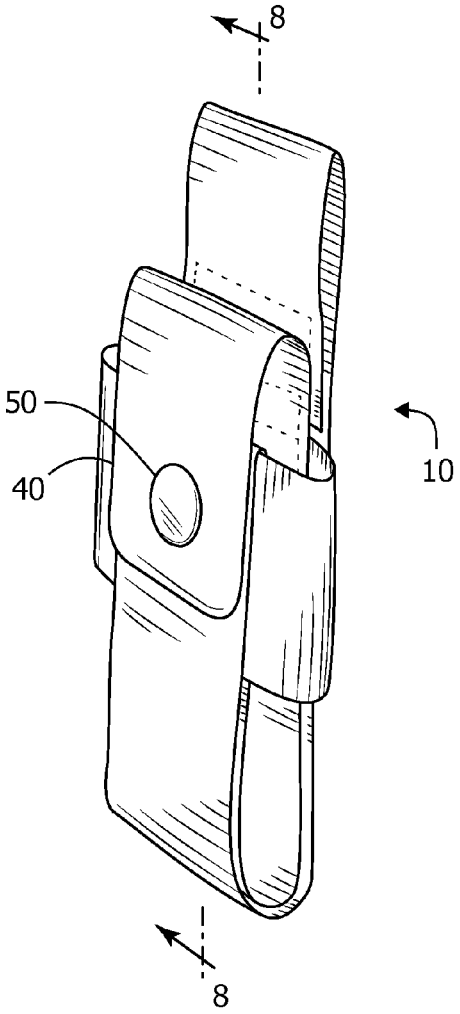
FIG. 7 shows the portable article carrier of FIG. 1 with an alternative closure flap finishing and attachment mechanism.
Figure 8:
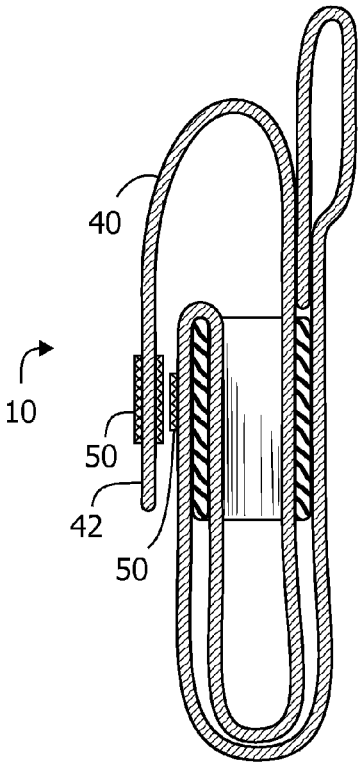
FIG. 8 shows a sectional view of the portable article carrier of FIG. 7.

FIG. 7 shows the portable article carrier 10 with an alternative finishing and attachment mechanism of the closure flap 40. FIG. 8 shows a sectional view of the portable article carrier 10 of FIG. 7. Referring to FIGS. 7-8, the closure flap 40 includes a snap fastener 50, also referred to in the art as a press stud, as an attachment mechanism. Referring to FIG. 8, the first strap portion distal end 42 is shown as finished without folding.

Figure 9:
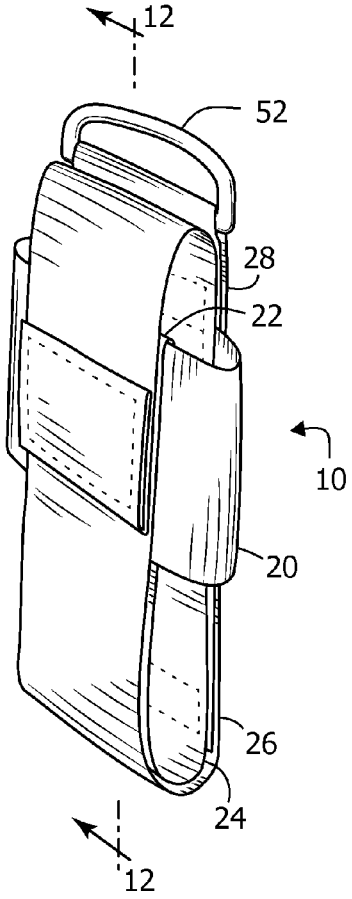
FIG. 9 shows the portable article carrier, in a front perspective view, including a support ring and an alternative treatment of the support loop portion.
Figure 10:
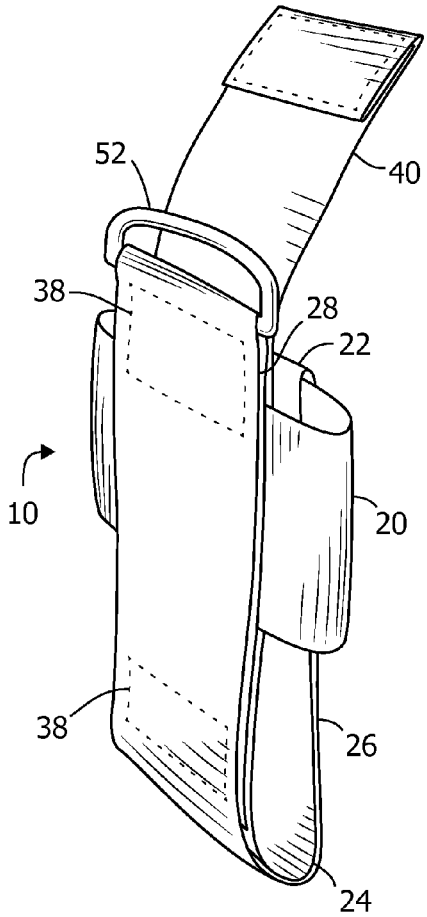
FIG. 10 shows the portable article carrier of FIG. 9 in a rear perspective view with the closure flap open.
Figure 11:
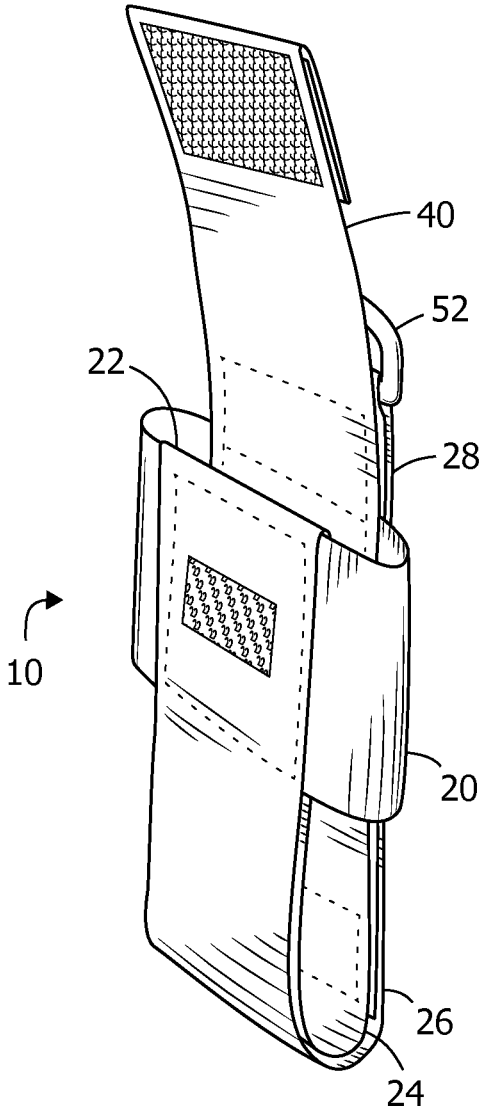
FIG. 11 shows the portable article carrier of FIG. 9 in a front perspective view with the closure flap open.
Figure 12:
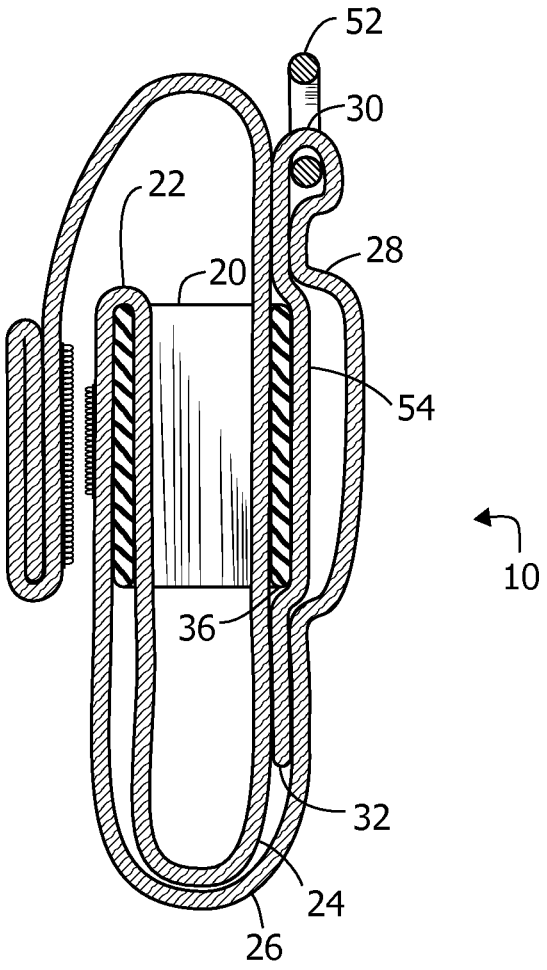
FIG. 12 shows a sectional view of the portable article carrier of FIG. 9.

It may be desirable to have alternate attachment options for the portable article carrier 10. FIGS. 9-12 show the portable article carrier 10, including a support ring 52 and an alternative treatment of the support loop portion 28. The support ring 52 illustrated is a D-ring, but other suitable shapes and types are possible. For example, the support ring 52 can be a ladder lock, bar slide, standard loop ring, tri-ring, or O-shaped ring. The support loop portion 28 is configured further down on the body of the portable article carrier 10 as compared to FIG. 1. FIG. 9 shows the portable article carrier 10 in a front perspective view, including a support ring 52 and an alternative treatment of the support loop portion 28. FIG. 10 shows the portable article carrier 10 of FIG. 9 in a rear perspective view with the closure flap 40 open. FIG. 11 shows the portable article carrier 10 of FIG. 9 in a front perspective view with the closure flap 40 open. FIG. 12 shows a sectional view of the portable article carrier 10 of FIG. 9. Referring to FIGS. 9-12, and as previously described, the first strap portion 24 and the second strap portion 26 extend downward from the first fold 22 and are looped back upward, forming the front and back of the portable article carrier 10. The first strap portion 24 forms the inside body of the portable article carrier 10. Opposing side portions of the loop member 20 are permanently secured between the first strap portion 24 and the second strap portion 26.

In FIGS. 3-5, the support loop portion 28 is shown permanently secured between the first strap portion 24 and the second strap portion 26 with the end of the support loop portion 28, which is the second strap portion distal end 32, positioned proximate to, or optionally abutting, the top of the loop member 20. Referring to FIG. 12, the support loop portion 28 is shown permanently secured between the first strap portion 24 and the second strap portion 26 with the end of the support loop portion 28, which is the second strap portion distal end 32, positioned below the bottom of the loop member 20. The opposing loop side portion 36 of the loop member 20 is permanently secured between the first strap portion 24 and the second strap portion 26 on the back of the portable article carrier 10. In FIG. 5 the portion of the second strap portion 26 permanently secured to the opposing loop side portion 36 is between the first fold 22 and the second fold 30. In FIG. 12, an inward folded section 54 of the second strap portion 26 is located between the second fold 30 and the second strap portion distal end 32. The portion of the second strap portion 26 permanently secured to the opposing loop side portion 36 is the inward folded section 54.

In FIG. 12, the inward folded section 54 of the second strap portion 26 is shown permanently secured to the outer portion of the support loop portion 28 at point above the top of the loop member 20 and at a point below the bottom of loop member 20. This arrangement defines a cavity for receiving the support ring 52 under or alternatively near to the second fold 30, and a cavity for receiving an external support strap, a waist belt, or the like, between the two points of securing. The permanent securing can be accomplished by methods previous disclosed. In FIG. 10, the permanent securing is accomplished by stitching 38. As previously described, the stitching pattern is for illustrative purposes only, and those skilled in the art will recognize appropriate stitching patterns.

Figure 13:
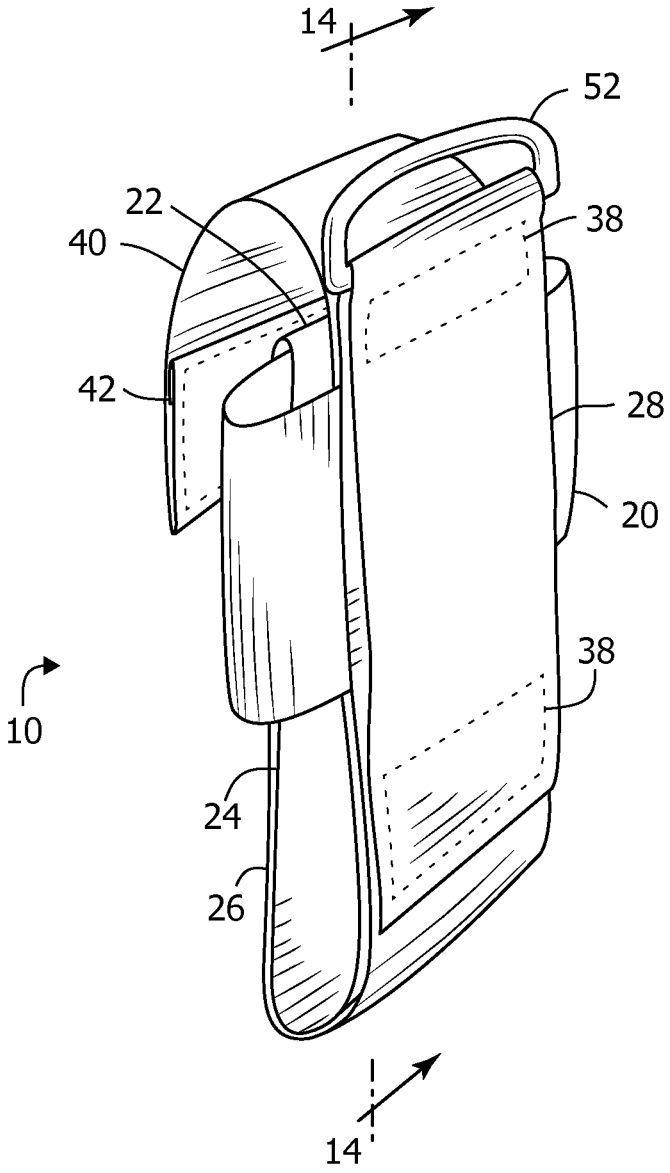
FIG. 13 shows a rear perspective view of the portable article carrier of FIG. 9 with an alternative closure flap finishing and attachment mechanism.
Figure 14:
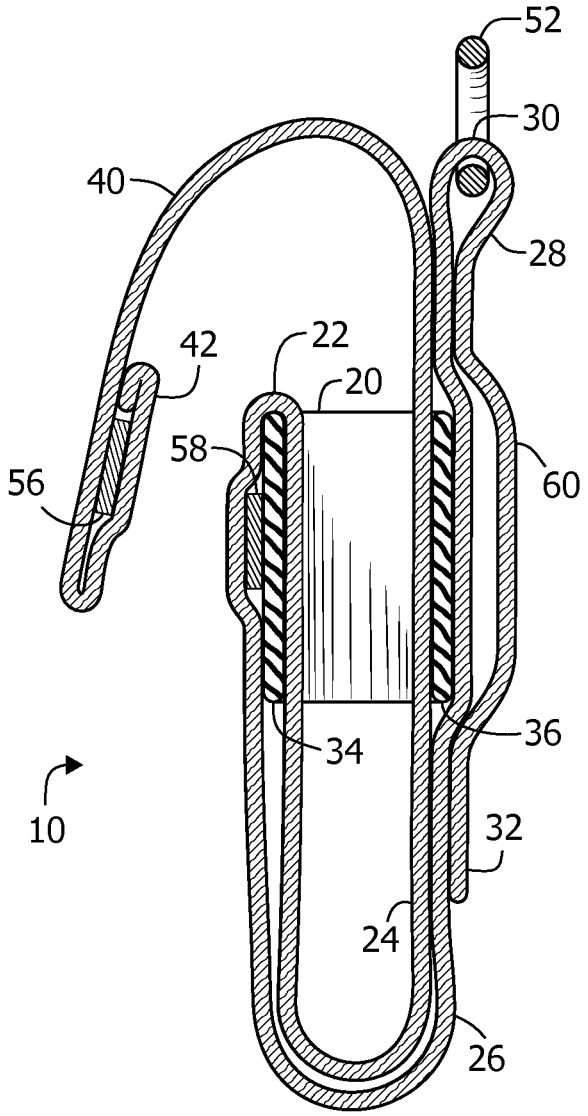
FIG. 14 shows a sectional view of the portable article carrier of FIG. 13.

FIG. 13 shows a rear perspective view of the portable article carrier 10 with an alternative finishing and attachment mechanism of the closure flap 40 and an alternative configuration of the support loop portion 28. FIG. 14 shows a sectional view of the portable article carrier 10 of FIG. 13. Referring to FIGS. 13-14, the first strap portion 24 and the second strap portion 26 extend downward from the first fold 22 and are looped back upward, forming the front and back of the portable article carrier 10. The first strap portion 24 forms the inside body of the portable article carrier 10. Opposing side portions of the loop member 20 are permanently secured between the first strap portion 24 and the second strap portion 26.

FIG. 14 shows the loop side portion 34 of the loop member 20 permanently secured between the first strap portion 24 and the second strap portion 26 proximate to the first fold 22. The opposing loop side portion 36 of the loop member 20 is permanently secured between the first strap portion 24 and the second strap portion 26 on the back of the portable article carrier 10. The loop side portion 34 and the opposing loop side portion 36 can be permanently secured at their respective positions between the first strap portion 24 and the second strap portion 26 by sewing, adhesives, or heat bonding.

The first strap portion distal end 42 of the first strap portion 24 is shown in FIGS. 13-14 with inward finishing folds. The closure flap 40 can be finished, for example, by sewing, adhesives, or heat-bonding. Those skilled in the art will readily recognize other methods of end finishing appropriate the closure flap 40. The closure flap 40 is secured by a magnetic latch. Referring to FIG. 14, the magnetic latch illustrated includes a first magnet 56 secured within the inward finishing folds of the closure flap 40 and a second magnet 58 secured between the first strap portion 24 and the second strap portion 26 in proximate alignment with the first magnet 56. Alternatively, the magnetic latch can use a single magnet and a portion of ferromagnetic material such as steel or iron.

FIG. 14 shows a support loop portion 28 with an outward folded section 60 defined by a portion of the second strap portion 26 between the second strap portion distal end 32 and the second fold 30. The outward folded section 60 is permanently secured to a section of the second strap portion 26 at a point above where the second strap portion 26 is permanently secured to loop member 20, defining a hollow cavity between the point of securing and the second fold 30, the hollow cavity adapted to receive the support ring 52. The outward folded section 60 is permanently secured to a section of the second strap portion 26 at a point above the top of the loop member 20 and at a point below the bottom of the loop member 20. The area between the two points of securing defines a cavity for receiving an external support, for example, the external support strap 48 of FIG. 6. The support loop portion 28 can be permanently secured by the methods previously described. In FIG. 13, the support loop portion 28 is permanently secured by sewing, indicated by stitching lines 38. The stitching lines 38 are for the purpose of illustration and should not be interpreted as favoring a particular stitching pattern; those skilled in the art will readily recognize other appropriate stitching patterns. It should also be noted that the support loop portion 28 can be removably fastened instead of permanently secured, for example, by a complementary closure.

Figure 15:
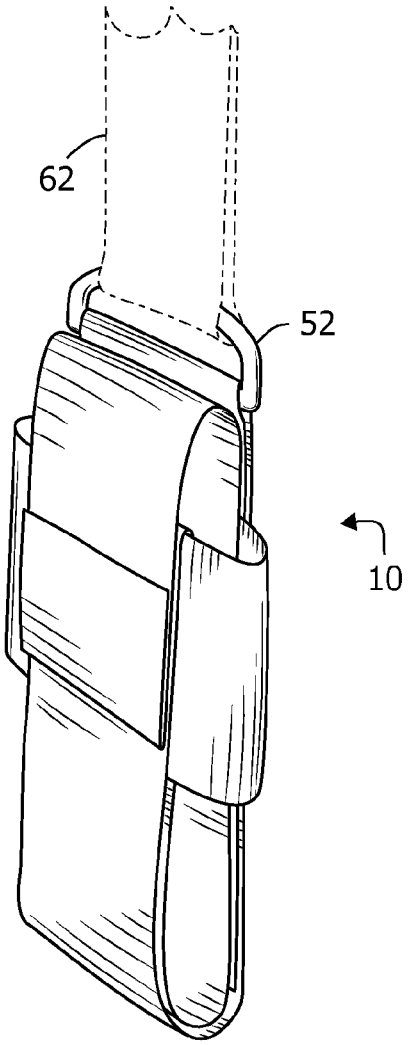
FIG. 15 shows a front perspective view of the portable article carrier of FIG. 9 attached to a hanging strap.

Using the support ring 52 described in FIGS. 9-14, it is possible to attach the portable article carrier 10 using a variety of support structures. FIG. 15 shows a front perspective view of the portable article carrier 10 of FIG. 9 attached to a hanging strap 62. The hanging strap 62 is attached to the support ring 52. The hanging strap 62 can be, for example, attached to a purse, hand bag, luggage, belt, or backpack.

Figure 16:
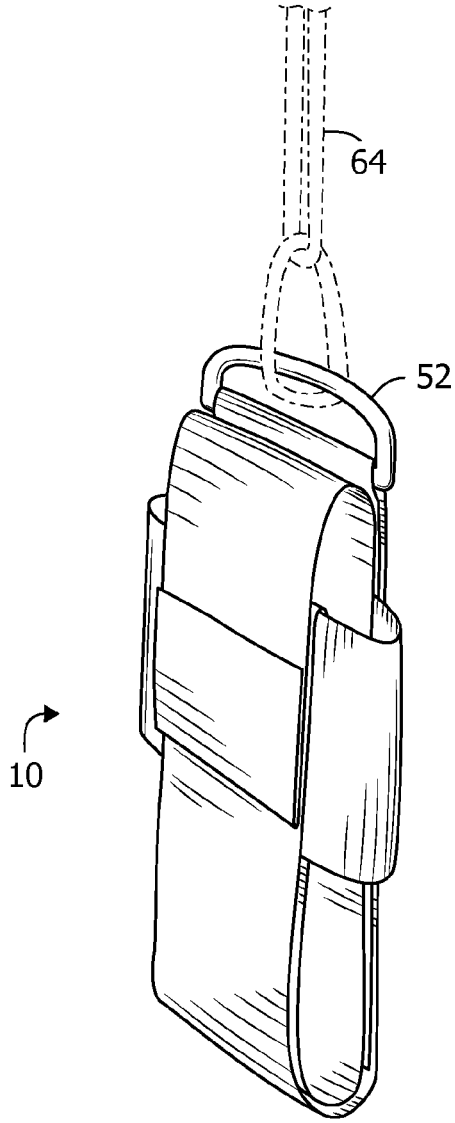
FIG. 16 shows a front perspective view of the portable article carrier of FIG. 9 suspended from a hanging rope.
Figure 17:
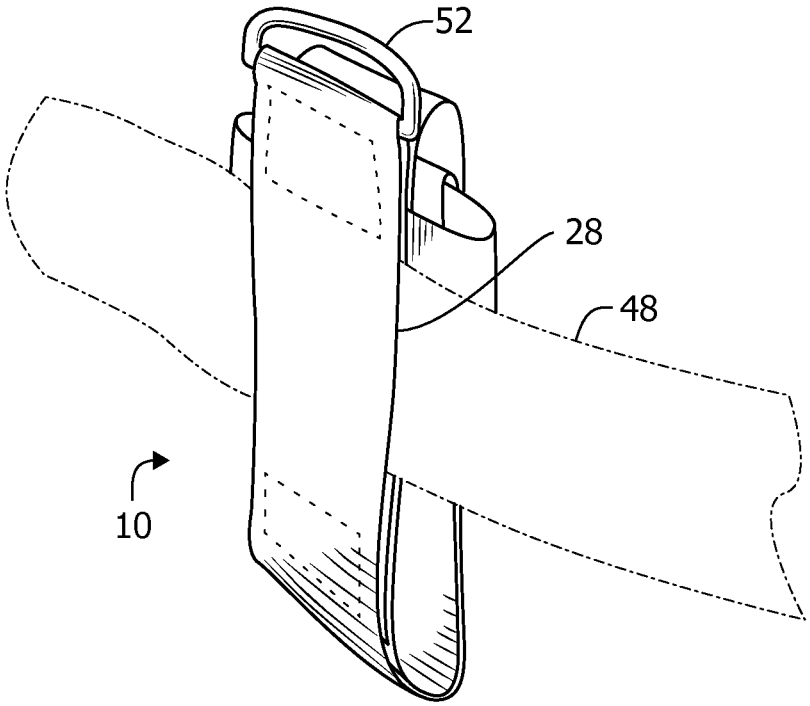
FIG. 17 shows in rear perspective view the portable article carrier of FIG. 9 attached to a support strap such as a belt.

FIGS. 15-17 show several methods of attaching and securing the portable article carrier 10 to an external object such as the hanging strap 62 of FIG. 15, a hanging rope 64 of FIG. 16, or the external support strap 48 in FIG. 17. Utilizing the support ring 52 of FIGS. 15-17, the portable article carrier 10 can be attached to a purse, handbag, backpack, or other object utilizing a hook or clip connected to the support ring 52.

FIG. 16 shows a front perspective view of the portable article carrier 10 of FIG. 9 attached to the hanging rope 64, or lanyard, or carabineer and rope combination, with the hanging rope 64 connected to the support ring 52. FIG. 17 shows, in rear perspective view, the portable article carrier 10 attached to the external support strap 48, such as the waist belt 16 of FIG. 1. The portable article carrier 10 can be attached to the external support strap 48 by slipping the external support strap 48 behind the support loop portion 28.

Figure 18A:
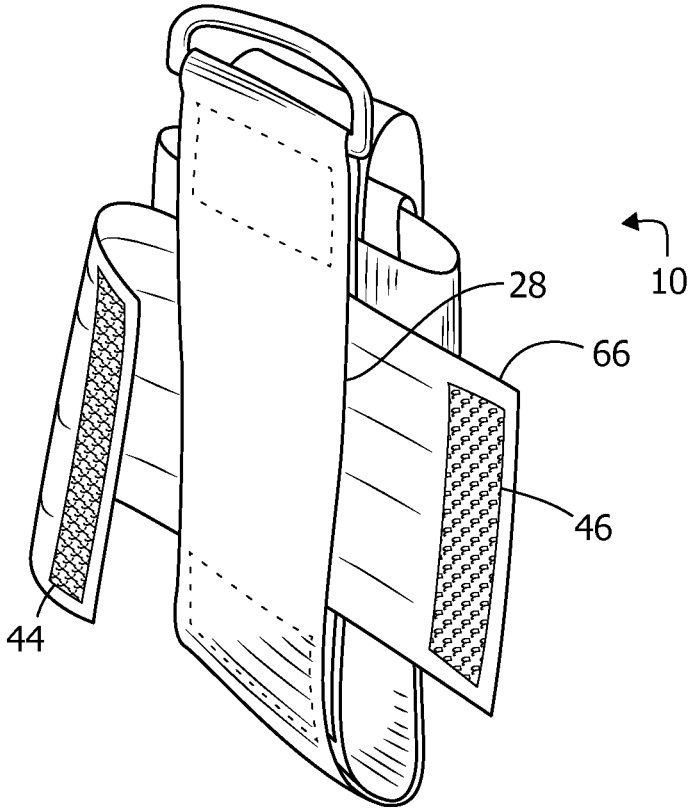
FIGS. 18A-18C show, in rear perspective views, a sequence of steps for securing the portable article carrier to an external support strap.
Figure 18B:
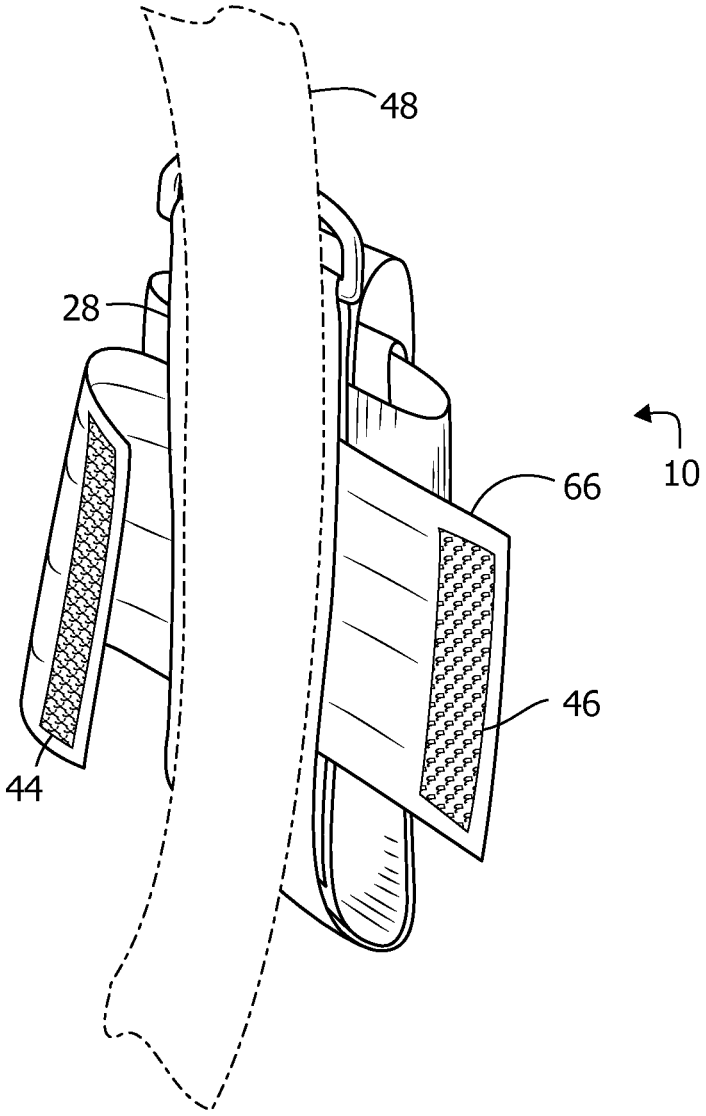
Figure 18C:
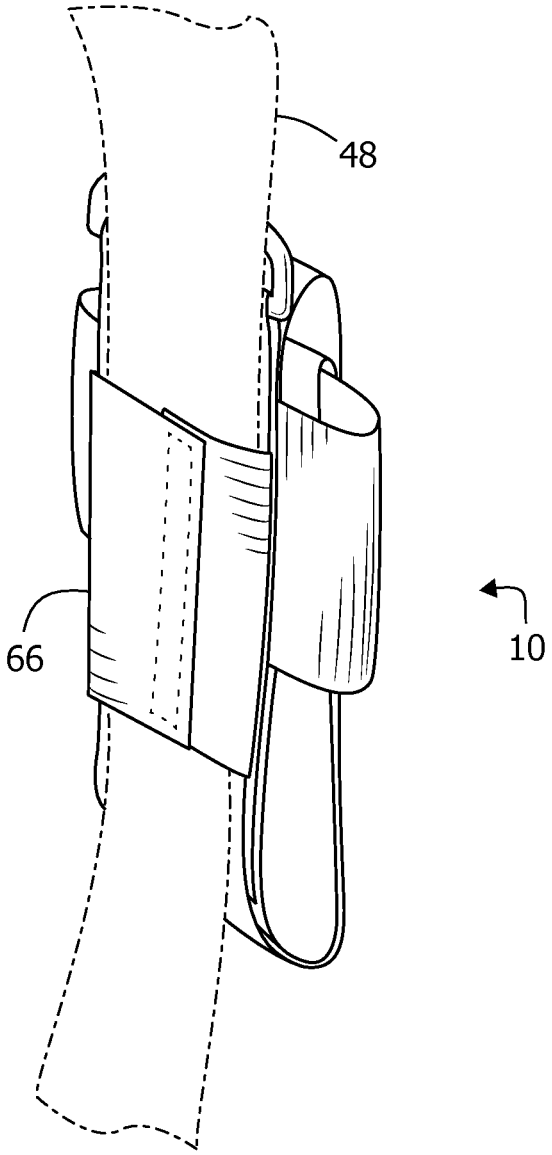

FIGS. 18A-18C show, in several rear perspective views, a sequence to removably secure the portable article carrier 10 of FIG. 9 to the external support strap 48 of FIGS. 18B-18C, parallel with respect to the top-to-bottom axis of to the portable article carrier 10. FIGS. 18A-18B illustrate the portable article carrier 10 with an accessory loop strap 66 inserted in to an opening behind the support loop portion 28. The accessory loop strap 66 is illustrated including a hook-and-loop fastening system. The loop component 44 of the hook-and-loop fastening system is permanently secured proximate to an end of the accessory loop strap 66. The hook component 46 of the hook-and-loop fastening system is permanently secured to the opposing end and the opposing side of the accessory loop strap 66. FIG. 18B shows the external support strap 48 aligned over the back of the portable article carrier 10. In FIG. 18C, the accessory loop strap 66 is shown in a closed position, with the hook-and-loop fasteners engaged, securing the portable article carrier 10.

Figure 19:
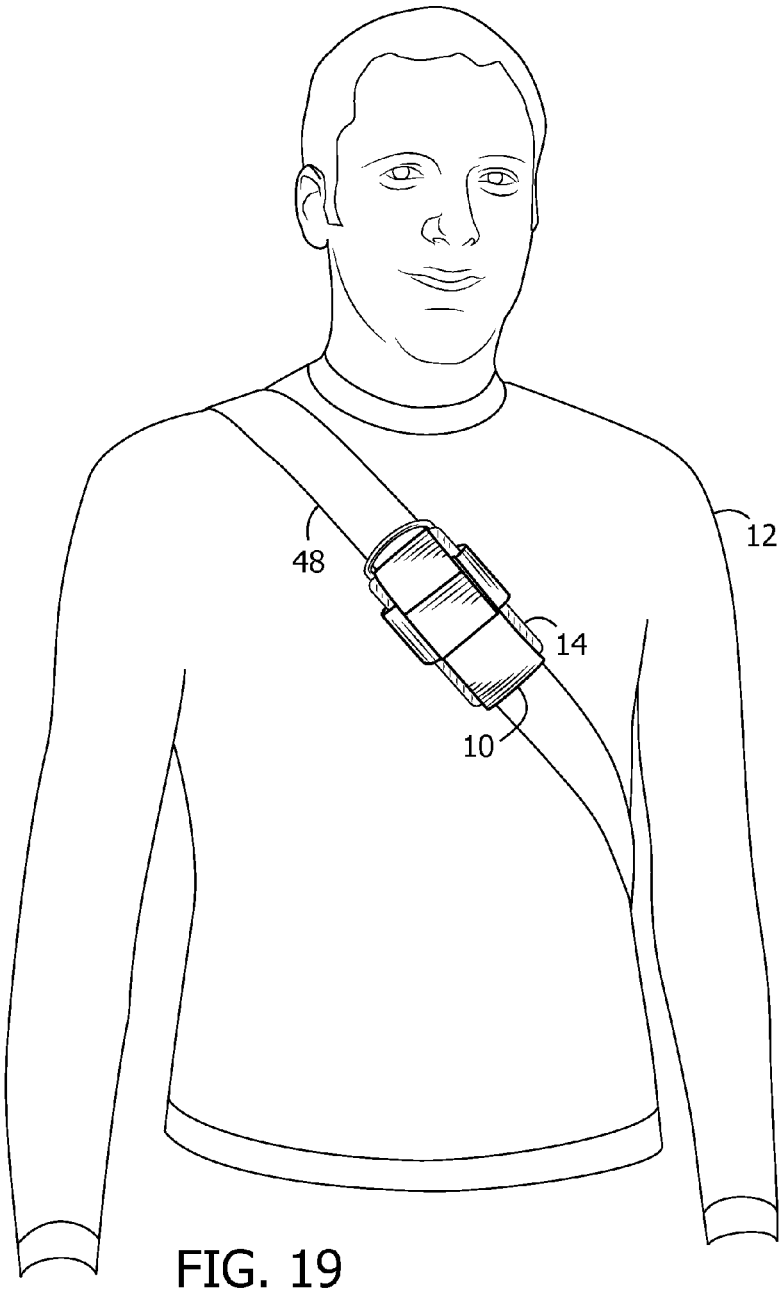
FIG. 19 shows a front view of the portable article carrier attached to a strap as in FIGS. 18A-18C shown worn by a wearer.
Figure 20:
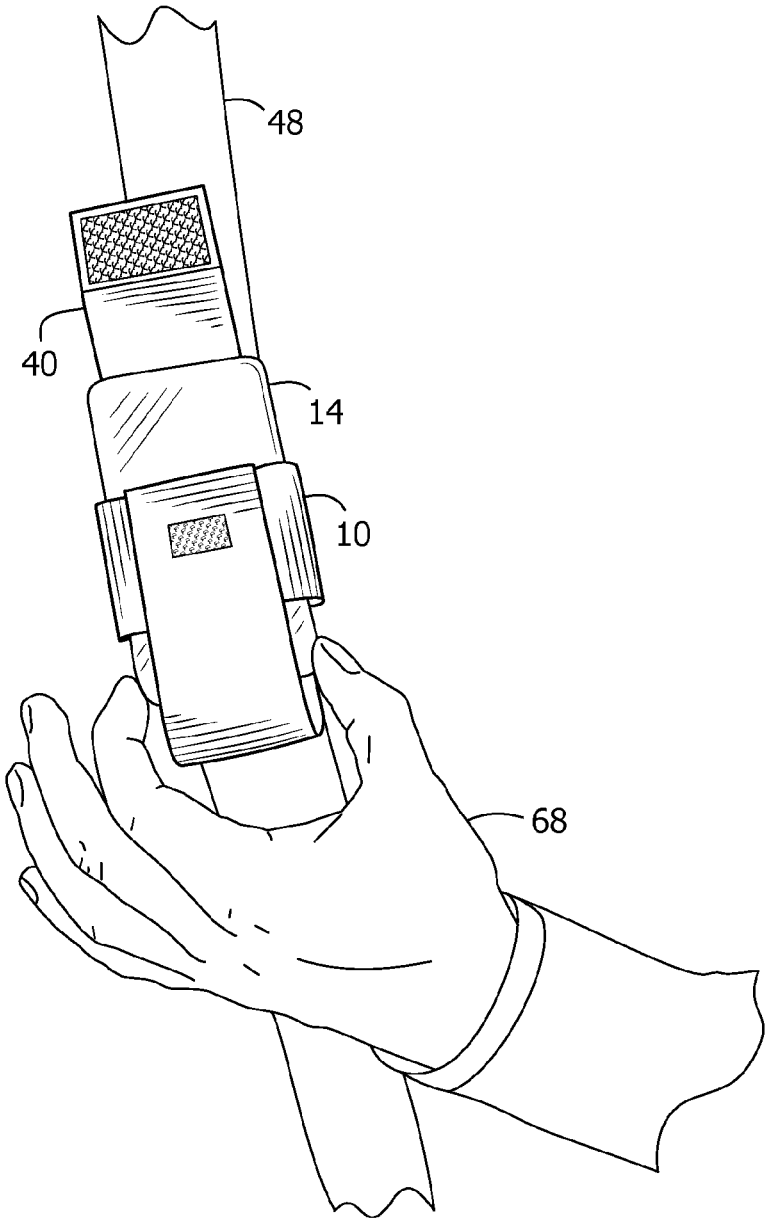
FIG. 20 shows removal of an article from the portable article carrier.

FIG. 19 shows a front view of the portable article carrier 10, show worn by the wearer 12, and attached to the external support strap 48 as in FIGS. 18A-18C. In FIG. 19, the portable article carrier 10 is shown carrying a portable article 14. FIG. 20 shows removal of the portable article 14 from the portable article carrier 10 while the portable article carrier 10 is attached to the external support strap 48. FIG. 20 illustrates, with the closure flap 40 open, the wearer's hand 68 pushes up the portable article 14 from the bottom from within the portable article carrier 10. Alternatively, the portable article 14 can be grasped from the top.

Figure 21A:
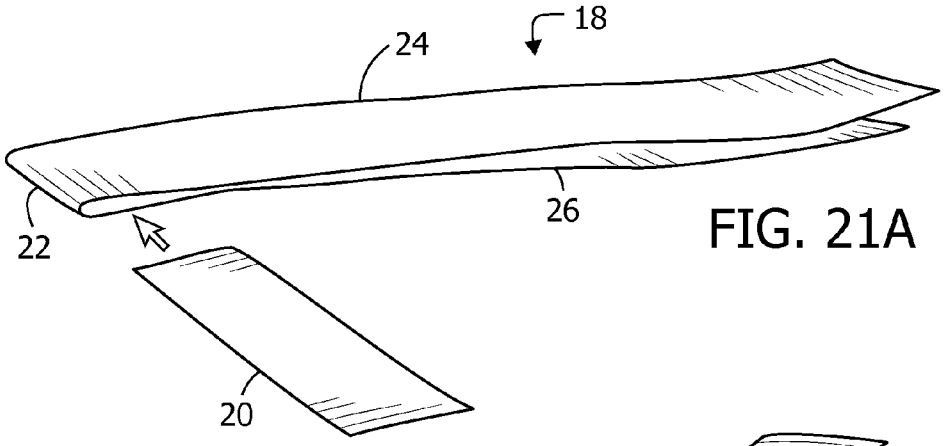
FIGS. 21A-21J show a sequence of steps for assembling the portable article carrier of FIG. 1.
Figure 21B:
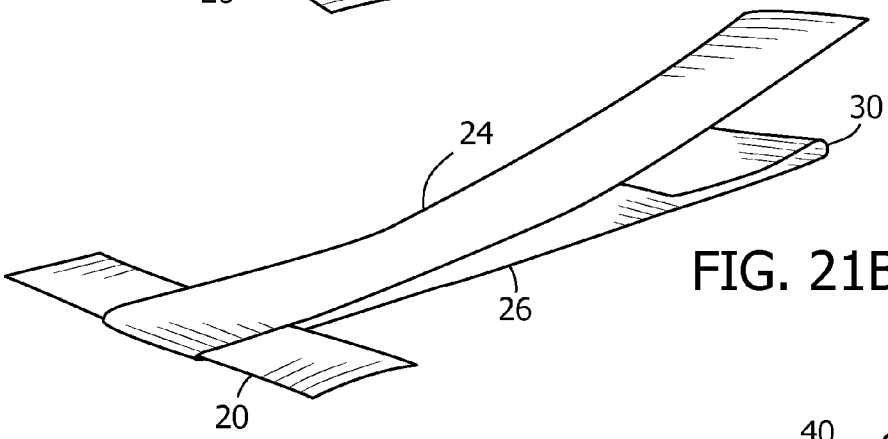
Figure 21C:
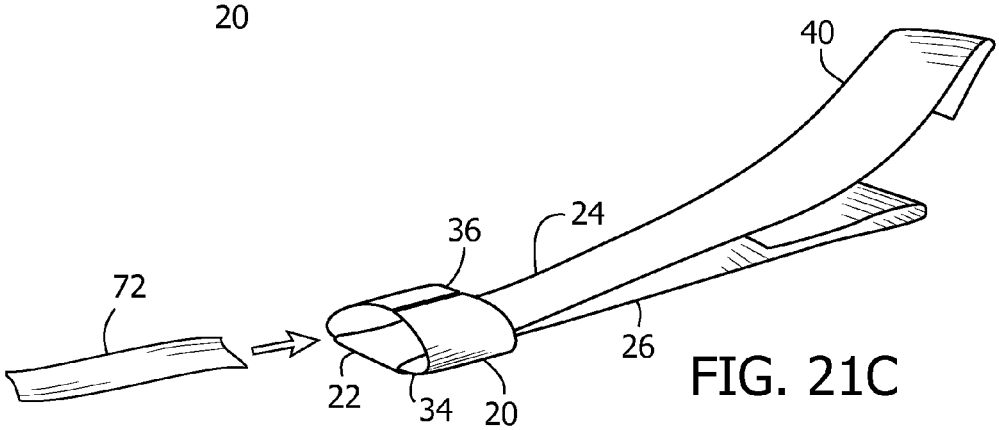
Figure 21D:
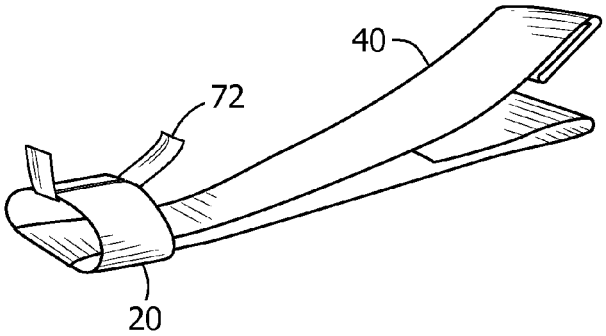
Figure 21E:
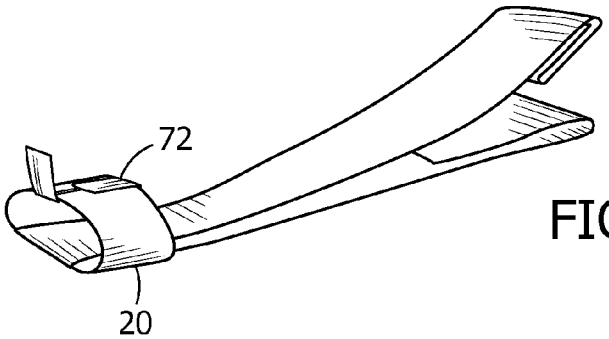
Figure 21F:
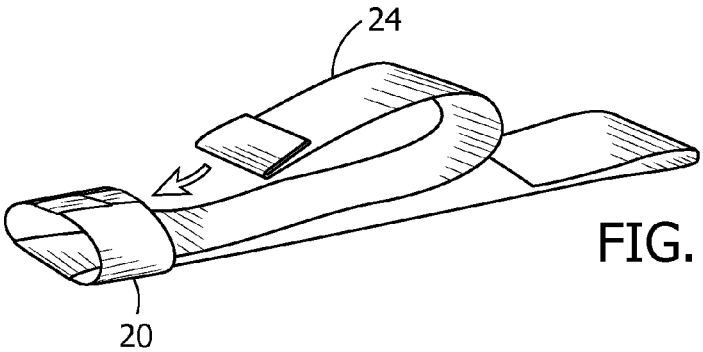
Figure 21G:
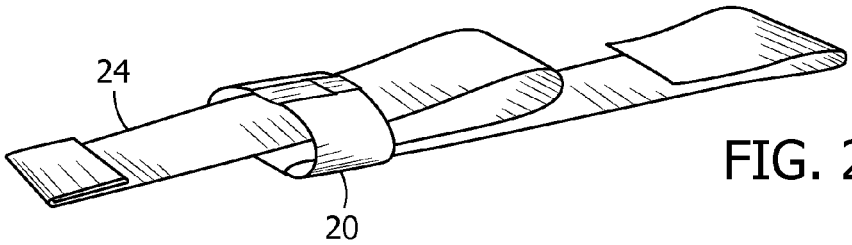
Figure 21H:
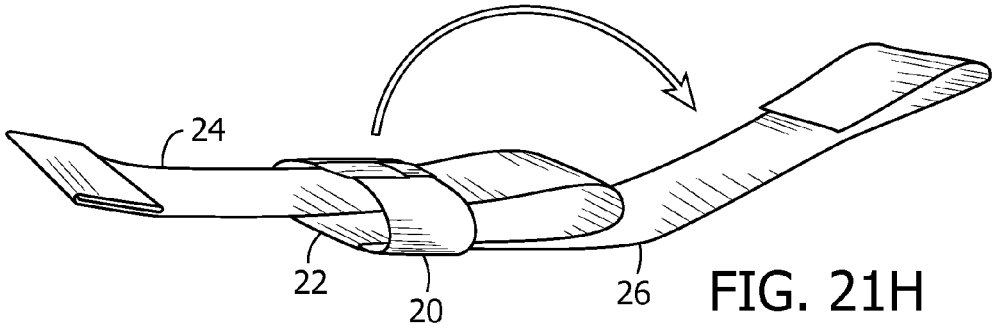
Figure 21I:
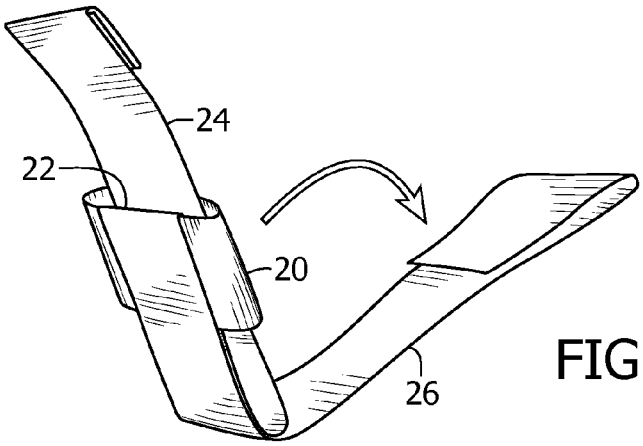
Figure 21J:
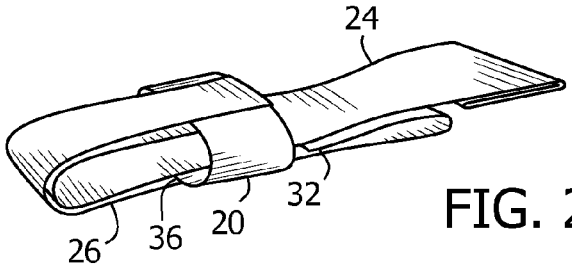

FIGS. 21A-21J show a sequence of steps for assembling the portable article carrier 10 shown in FIG. 1. These steps are shown to illustrate a typical assembly process of one of the portable article carriers disclosed; it is not meant to limit a claimed method or process to the described sequence of steps. In FIG. 21A, the loop member 20 is inserted between the first strap portion 24 and the second strap portion 26 proximate to the first fold 22. The loop member 20 is shown as separate from the strap member 18, in that it starts out as an independent element. In FIG. 21B, the loop member 20 is permanently secured to the first strap portion 24 and the second strap portion 26. This can be accomplished, for example, by sewing, adhesive, or heat-bonding, as previously described. The second fold 30 is shown as an inward fold. This is for illustrative purposes. The second fold 30 can also be outwardly folded, as previously described. In FIG. 21C, the loop member 20 is folded into the shape of a loop, ring, or band. The loop member 20 having a loop side portion 34 positioned between the first strap portion 24 and the second strap portion 26 proximate to the first fold 22. The loop member 20 includes an opposing loop side portion 36. In FIGS. 21C-21E, for ease of assembly, the abutted ends of the loop member 20 can be joined using tape 72, for example, bias tape, hemming tape, or fusible tape. In FIG. 21C, the closure flap 40 is show folded for finishing. In FIG. 21D, the closure flap 40 is folded again and permanently joined. In FIGS. 21F-21G, the first strap portion 24 is looped through the interior of loop member 20. In FIGS. 21H-21I, the second strap portion 26 is brought together with the assembly that includes the loop member 20, the first strap portion 24 and second strap portion 26 permanently secured near the first fold 22. In FIG. 21J, the opposing loop side portion 36 is permanently secured to the first strap portion 24 and the second strap portion 26. The second strap portion distal end 32 is shown abutting the top edge of the loop member 20. The second strap portion distal end 32 is positioned between and permanently secured to the first strap portion 24 and the second strap portion 26.

Figure 22A:
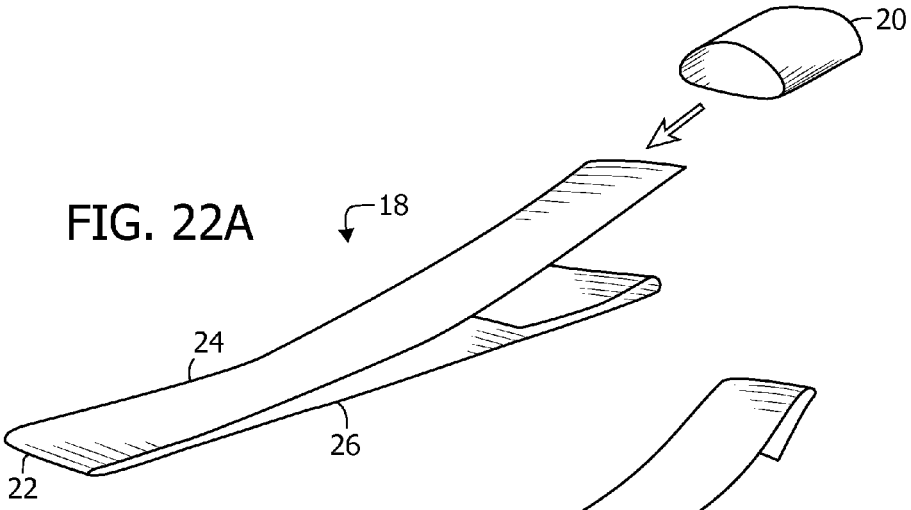
FIGS. 22A-22D show a sequence of steps for assembling the portable article carrier of FIG. 1 where the loop member is formed as a continuous closed loop.
Figure 22B:
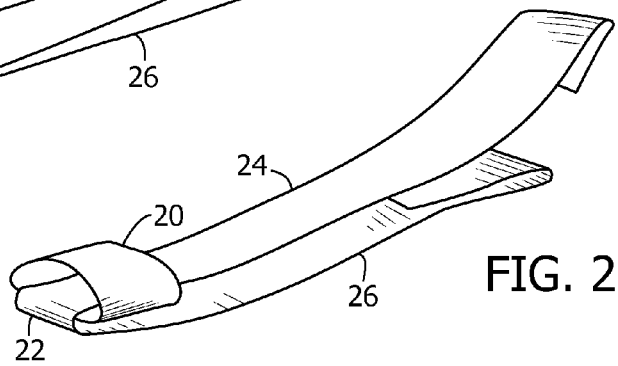
Figure 22C:
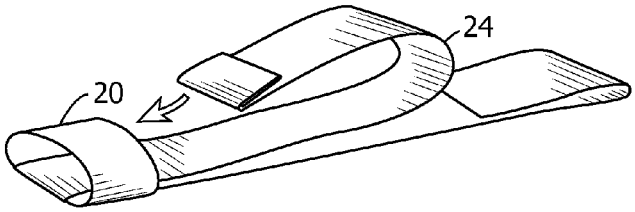
Figure 22D:
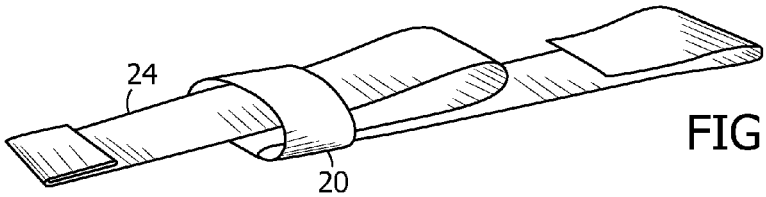

FIGS. 22A-22D show a sequence of steps for assembling the portable article carrier 10 shown in FIG. 1 where the loop member 20 is formed as a continuous closed loop. In FIG. 22A, the loop member 20 is shown as separate from the strap member 18, in that it starts out as an independent element. In FIGS. 22A-22D, the loop member 20 is a continuous band. In FIGS. 22A-22B, the loop member 20 is moved into position between the first strap portion 24 and the second strap portion 26 proximate to the first fold 22. In FIGS. 22C-22D, the first strap portion 24 is looped through the loop member 20 as illustrated. The remainder of the assembly process can proceed as described in FIGS. 21H-21J.

Figure 23A:
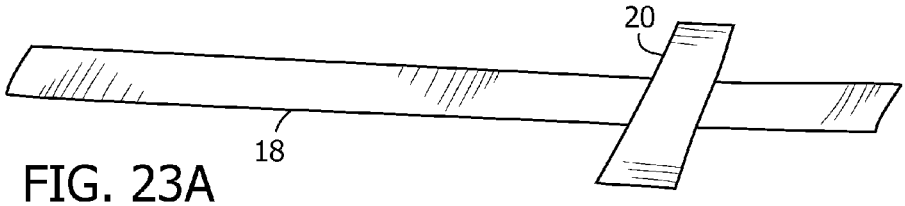
FIGS. 23A-23E show an alternate sequence of steps for assembling the portable article carrier of FIG. 1.
Figure 23B:
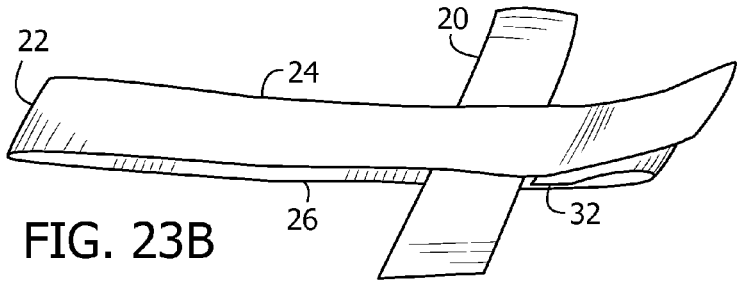
Figure 23C:
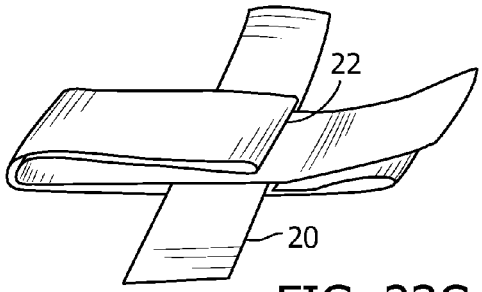
Figure 23D:
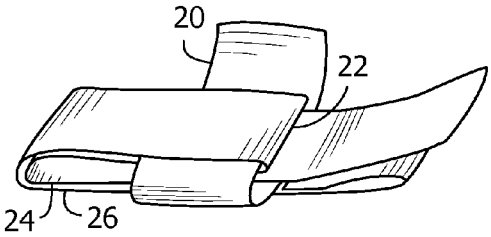
Figure 23E:
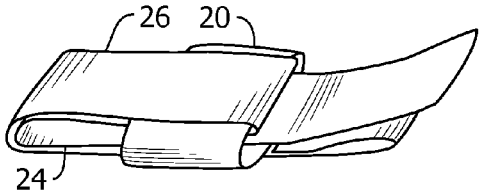

FIGS. 23A-23E show an alternate sequence of steps for assembling the portable article carrier 10 shown in FIG. 1. In FIG. 23A, the loop member 20 is shown laid over the strap member 18 forming a cross shape. In FIG. 23B the first strap portion 24 and second strap portion 26 are defined by the first fold 22. The first strap portion 24 is folded over the cross shape combination of the loop member 20 and second strap portion 26. The second strap portion distal end 32 is positioned between the first strap portion 24 and the second strap portion 26 and abuts the top edge of the loop member 20. The second strap portion distal end 32 can be permanently secured to the first strap portion 24 and the second strap portion 26 in this step. In FIG. 23C, the first fold 22 is positioned approximately even with the top of the loop member 20. In FIG. 23D, the loop member 20 is positioned between the first strap portion 24 and the second strap portion 26 proximate to the first fold 22. In FIG. 23E, the loop member 20 is permanently secured to the first strap portion 24 and the second strap portion 26. Examples of various methods of permanently securing have been described previously in this disclosure.

Figure 24:
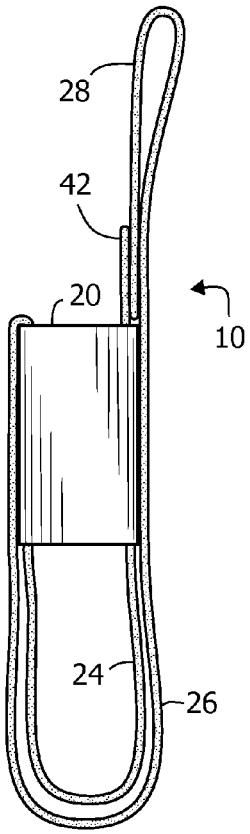
FIG. 24 shows a side view of the portable article carrier with an open case.
Figure 25:
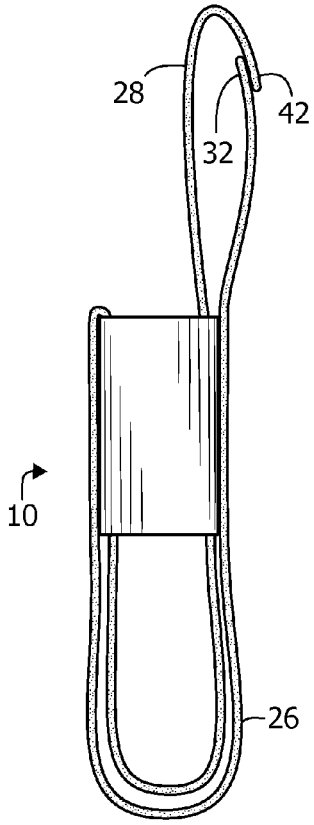
FIG. 25 shows a side view of the portable article carrier of FIG. 24 with an alternate support loop portion.
Figure 26:
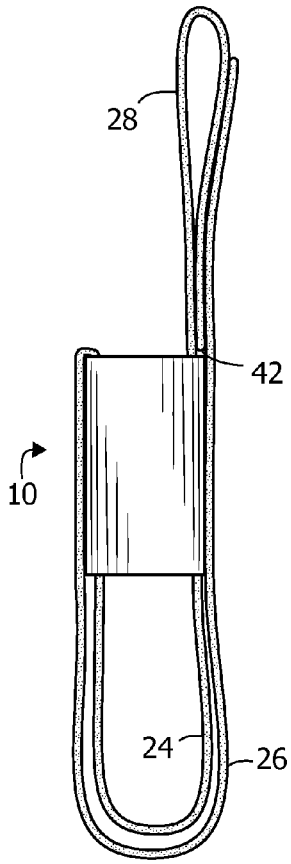
FIG. 26 shows a side view of the portable article carrier without a closure flap, and with an alternate support loop portion.

FIGS. 24-26 show side views of alternate configurations of the portable article carrier 10 without a cover flap. FIG. 24 shows the portable article carrier 10 with the second strap portion 26 securable to the first strap portion 24 at a position between the first strap portion distal end 42 and where the first strap portion 24 meets the top of the loop member 20. This forms the support loop portion 28 previously described. The second strap portion 26 can be permanently secured, as previously described, to the first strap portion 24 between the first strap portion distal end 42 and the top of the loop member 20. Alternatively, it can be removably secured using a complementary closure, for example, a button snap, a button and button-hole combination, a hook-and-loop fastening system, or a magnetic latch.

FIG. 25 shows the portable article carrier 10 with an alternate closure for the support loop portion 28. In FIG. 25, the first strap portion distal end 42 is secured to the second strap portion 26 proximate to the second strap portion distal end 32 forming the support loop portion 28.

FIG. 26 shows the portable article carrier 10 with the first strap portion distal end 42 positioned between and permanently secured to the first strap portion 24 and the second strap portion 26 forming the support loop portion 28.

Figure 27:
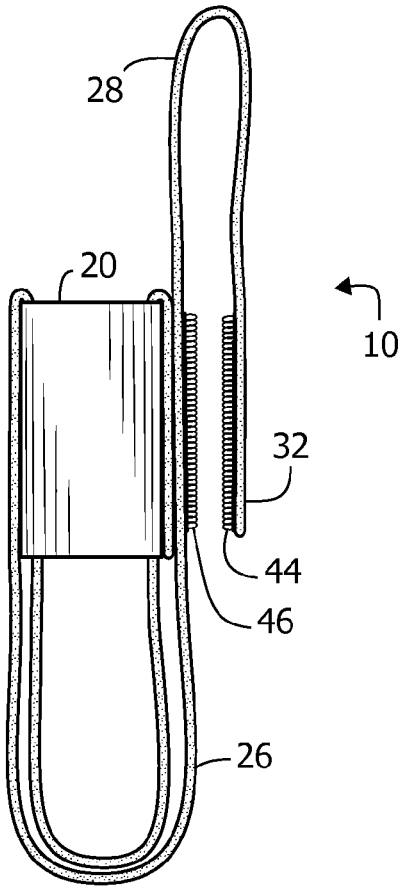
FIG. 27 shows a side view of a portable article carrier where the second strap portion is removably secured to itself forming the support loop portion.

FIG. 27 shows a side view of the portable article carrier 10 where the second strap portion 26 is removably secured to itself forming the support loop portion 28. In FIG. 27, the second strap portion distal end 32 is removably secured to the second strap portion 26 proximate to the loop member 20 by a hook-and-loop fastening mechanism. The loop component 44 of the hook-and-loop fastening mechanism is shown positioned on, and permanently secured to, the second strap portion distal end 32. The hook component 46 of the hook-and-loop fastening mechanism is shown positioned on, and permanently secured to, the second strap portion 26 proximate to the loop member 20. The positions of the loop component 44 and the hook component 46 can be reversed. In that instance, the hook component 46 would be permanently secured proximate to the second strap portion distal end 32. While a hook-and-loop fastening mechanism has been shown, other complementary closures can be used, such as a snap fastener, or a button and button-hole combination.

Figure 28:
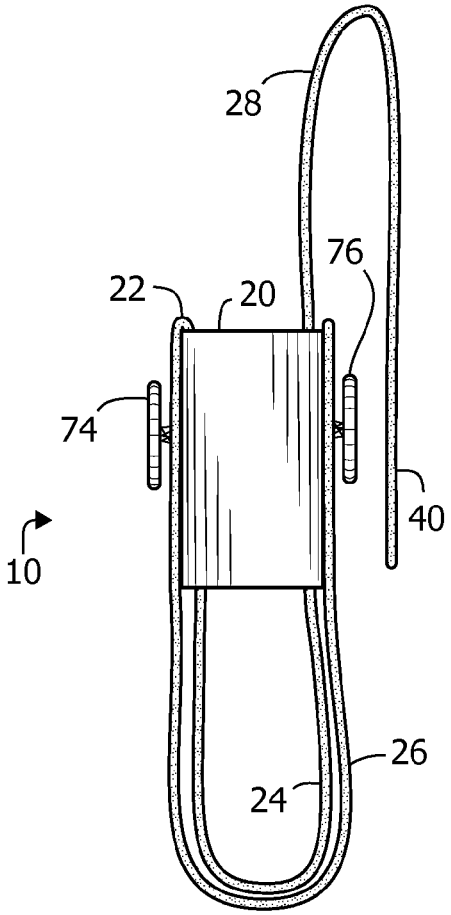
FIG. 28 shows a side view of a portable article carrier where the first strap portion can act as a closure flap or form part of the support loop portion.
Figure 29:
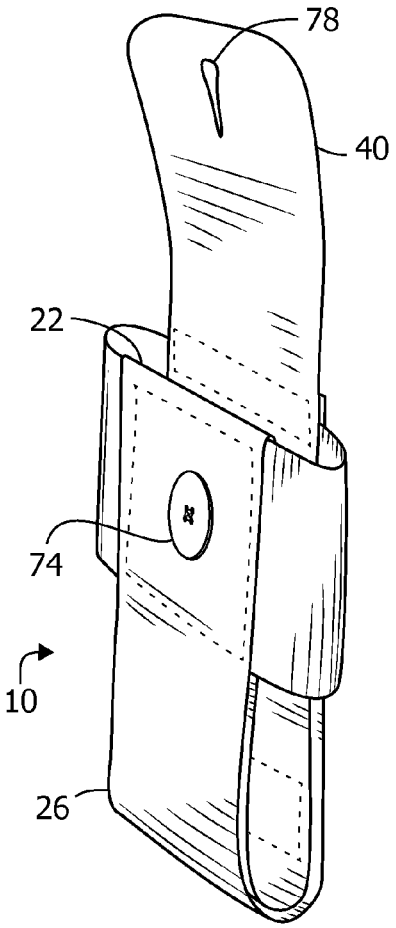
FIG. 29 shows a front perspective view of the portable article carrier of FIG. 28.
Figure 30:
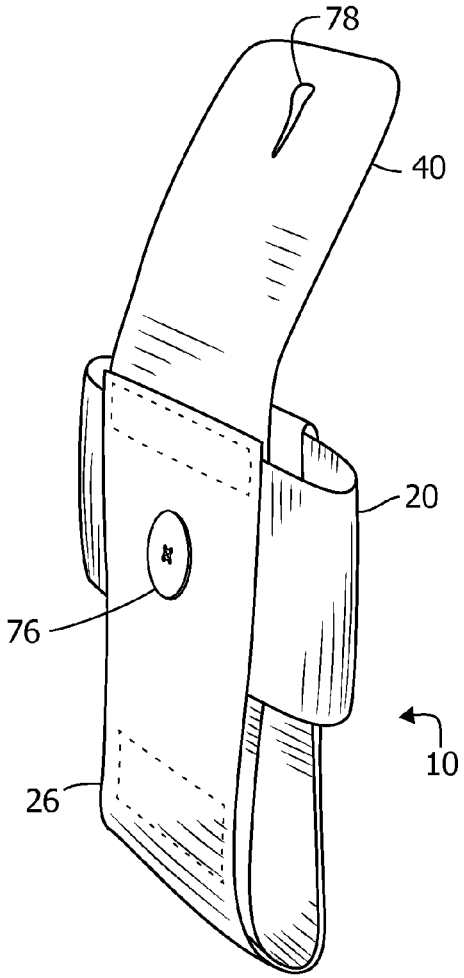
FIG. 30 shows a back perspective view of the portable article carrier of FIG. 28.

FIG. 28 shows a side view of a portable article carrier 10 where the closure flap 40 is removably attachable to the front portion and the back portion of the portable article carrier. This allows the closure flap 40 of the first strap portion 24 to act as a cover flap or form part of a support loop portion 28. FIG. 29 shows a front perspective view of the portable article carrier 10 of FIG. 28. FIG. 30 shows a back perspective view of the portable article carrier 10 of FIG. 29. Referring to FIGS. 28-29, a first button 74 is permanently secured to the second strap portion 26. The first button 74 is positioned on the front of the portable article carrier 10 near the first fold 22. Referring to FIGS. 28 and 30, a second button 76 is permanently secured to the second strap portion 26 on the back of the portable article carrier 10 proximate to the loop member 20. Referring to FIGS. 29-30, a button hole 78, positioned on the closure flap 40, can engage and secure either the first button 74 of FIG. 29 or the second button 76 of FIG. 30. This allows the possibility of a portable article carrier 10 where the closure flap 40 can be used as a support loop portion.

FIGS. 28-30 show a portable article carrier 10 with a button closure where the closure flap 40 can also be used as a support loop portion. Other complementary closures, such as a hook-and-loop fastener, or a button snap, can be substituted for the button fastener. FIGS. 28-30 show a portable article carrier where the closure flap 40 is removably securable to the front portion of the portable article carrier 10 and removably securable to the back portion of the portable article carrier. Referring to FIG. 27, it is also possible to adapt the support loop portion 28 so that the second strap portion distal end 32 is removably securable to the front portion of the portable article carrier and removably securable to the back portion of the portable article carrier. This can be accomplished by permanently attaching a complementary closure to both sides of the second strap portion distal end 32 and to the front portion of the portable article carrier in a similar manner as described for FIG. 28 for securing the closure flap 40.

A portable article carrier 10, in several aspects and embodiments, has been described. It is not the intent of this disclosure to limit the claimed invention to the aspects, examples, variations, and embodiments described in the specification. Those skilled in the art will recognize that variations will occur when embodying the claimed invention in specific implementations and environments. For example, it is possible to implement certain features described in separate embodiments in combination within a single embodiment. Similarly, it is possible to implement certain features described in single embodiments either separately or in combination in multiple embodiments. It is the intent of the inventor that these variations fall within the scope of the claimed invention. While the examples, exemplary embodiments, and variations are helpful to those skilled in the art in understanding the claimed invention, it should be understood that the scope of the claimed invention is defined solely by the following claims and their equivalents.

What is claimed is:

1. A portable article carrier, comprising:

a flexible strap member, including a fold defining a first strap portion and a second strap portion, the second strap portion including a second strap portion distal end;

a loop member, separate from the flexible strap member, including a loop side portion and an opposing loop side portion;

the loop side portion positioned between and permanently secured to the first strap portion and the second strap portion proximate to the fold;

the opposing loop side portion positioned between and permanently secured to the first strap portion and the second strap portion; and the second strap portion distal end permanently secured to the second strap portion and positioned between the first strap portion and the second strap portion.

2. The portable article carrier of claim 1, wherein: the first strap portion includes a first strap portion distal end, the first strap portion distal end defining a closure flap.

3. The portable article carrier of claim 2, wherein:

the loop member includes a top edge; and the second strap portion distal end abuts the top edge of the loop member.

4. A portable article carrier, comprising:

a flexible strap member, including a fold defining a first strap portion and a second strap portion;

a loop member, separate from the flexible strap member, including a loop side portion and an opposing loop side portion;

the loop side portion positioned between and permanently secured to the first strap portion and the second strap portion proximate to the fold;

the opposing loop side portion positioned between and permanently secured to the first strap portion and the second strap portion;

the first strap portion including a first strap portion distal end, the first strap portion distal end defining a closure flap;

a front portion of the portable article carrier defined by a first region of the second strap portion that is proximal to the fold;

a back portion of the portable article carrier defined by a second region of the second strap portion that is proximal to the opposing loop side portion; and the closure flap removably securable to the front portion of the portable article carrier and removably securable to the back portion of the portable article carrier.

5. A portable article carrier, comprising:

a flexible strap member, including a fold defining a first strap portion and a second strap portion, the second strap portion including a second strap portion distal end;

a loop member, separate from the flexible strap member, including a loop side portion and an opposing loop side portion;

the loop side portion positioned between and permanently secured to the first strap portion and the second strap portion proximate to the fold;

the opposing loop side portion positioned between and permanently secured to the first strap portion and the second strap portion;

a support loop portion defined by the second strap portion distal end permanently secured to the second strap portion;

a support ring; and the second strap portion joined to itself within the support loop portion defining an area for receiving and holding the support ring.

* * * * *